US011536279B1

(12) United States Patent
Tzeng

(10) Patent No.: US 11,536,279 B1
(45) **Date of Patent: *Dec. 27, 2022**

(54) THIN TYPE COUNTER-ROTATING AXIAL AIR MOVING DEVICE

(71) Applicant: STOKES TECHNOLOGY DEVELOPMENT LTD., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/688,753

(22) Filed: Mar. 7, 2022

(51) Int. Cl.

| | |
|---|---|
| ***F04D 19/02*** | (2006.01) |
| ***F04D 19/00*** | (2006.01) |
| ***F04D 25/06*** | (2006.01) |
| ***F04D 25/08*** | (2006.01) |
| ***F04D 29/32*** | (2006.01) |

(52) U.S. Cl.
CPC ..... *F04D 19/024* (2013.01); *F04D 19/026* (2013.01); *F04D 25/0606* (2013.01); *F04D 25/08* (2013.01); *F04D 29/326* (2013.01); *F04D 19/007* (2013.01); *F05D 2210/12* (2013.01)

(58) Field of Classification Search
CPC .. F04D 19/007; F04D 19/024; F04D 19/0026; F04D 25/06; F04D 25/0606; F04D 25/0613; F04D 25/166; F04D 29/327; F04D 29/329; F04D 29/384; F04D 19/026
See application file for complete search history.

(56) References Cited

U.S. PATENT DOCUMENTS

| | | | | |
|---|---|---|---|---|
| 6,537,019 | B1 * | 3/2003 | Dent | F04D 25/166 361/679.48 |
| 6,544,010 | B1 * | 4/2003 | Choi | F04D 25/08 416/223 R |
| 11,486,402 | * | 11/2022 | Tzeng | F04D 19/024 |
| 2003/0121915 | A1 * | 7/2003 | Shon | H05B 6/642 219/757 |
| 2005/0110366 | A1 * | 5/2005 | Chang | H02K 7/14 310/68 B |
| 2007/0059155 | A1 * | 3/2007 | Ishihara | F04D 19/024 415/60 |
| 2008/0156282 | A1 * | 7/2008 | Aschermann | F04D 29/386 123/41.49 |
| 2021/0199119 | A1 * | 7/2021 | Guo | F04D 19/007 |
| 2021/0274078 | A1 * | 9/2021 | Hanjo | F04D 25/166 |

* cited by examiner

*Primary Examiner* — Devon C Kramer
*Assistant Examiner* — Joseph S. Herrmann
(74) *Attorney, Agent, or Firm* — Chun-Ming Shih; HDLS IPR Services

(57) ABSTRACT

This disclosure is related to a thin type counter-rotating axial air moving device. The ratio of the front hub diameter to the front blade diameter is about 0.3 to about 0.85. The front average pitch angle of the front blades is greater than about 46 degrees. The ratio of the rear hub diameter to the rear blade diameter is about 0.3 to about 0.85. The rear average pitch angle of the rear blades is less than about 38 degrees. The ratio of the total thickness to the greater one between the front blade diameter and the rear blade diameter is less than or equal to about 0.75.

5 Claims, 9 Drawing Sheets

THIN TYPE COUNTER-ROTATING AXIAL AIR MOVING DEVICE

BACKGROUND OF THE DISCLOSURE

Technical Field

The technical field relates to an axial air moving device, and more particularly relates to a counter-rotating axial air moving device for cooling.

Description of Related Art

An axial air moving device for cooling is composed of a motor, a hub and a plurality of blades arranged around the hub. The motor drives the hub to rotate to let the blades push the fluid flowing. Moreover, the axial air moving device has to generate not only high air flowrate, but also sufficient air pressure to effectively overcome the flow resistance of the environment for cooling. Accordingly, in order to improve the characteristics of static pressure versus air flowrate of the axial air moving device, the optimal performance is mostly obtained by adjusting the size and angle of the blades. The counter-rotating axial air moving device is also adopted to overcome high back pressure.

The counter-rotating axial air moving device in the related art may not withstand a high back pressure when the thickness is thin, and the performance may be significantly degraded. Therefore, the related-art counter-rotating axial air moving device usually achieves a higher air pressure by increasing the thickness. However, it is difficult to significantly increase the thickness in the common application space. After the thickness reaching a certain level, the performance may be improved by increasing the rotation speed in the related art. However, this may cause deterioration in vibration and noise of the counter-rotating axial air moving device. In addition, the increase of thickness may require a greater installation space.

However, due to the ever increasing demand of air flow for cooling in recent years, how to improve the performance of the contra-rotating air moving devices in limited space is the research motivation of the disclosure.

SUMMARY OF THE DISCLOSURE

One object of this disclosure is to provide a thin type counter-rotating axial air moving device to improve the curve of the air pressure and air flowrate of the counter-rotating axial air moving device in limited space, and the required space is reduced.

In order to achieve the object mentioned above, this disclosure provides a thin type counter-rotating axial air moving device including a front rotor fan and a rear rotor fan. The front rotor fan includes a front hub and a plurality of front blades arranged annularly on a periphery of the front hub spacedly. The front hub includes a front hub diameter, and each of the front blades includes a front blade diameter and a front average pitch angle. A ratio of the front hub diameter to the front blade diameter is about 0.3 to about 0.85, and the front average pitch angle is greater than about 46 degrees. The rear rotor fan is disposed on a downstream side of the front rotor fan. The rear rotor fan includes a rear hub and a plurality of rear blades arranged annularly on a periphery of the rear hub spacedly. The rear hub includes a rear hub diameter, and each of the rear blades includes a rear blade diameter and a rear average pitch angle. A ratio of the rear hub diameter to the rear blade diameter is about 0.3 to about 0.85. The rear average pitch angle is less than about 38 degrees. An amount of the front blades is greater than or equal to an amount of the rear blades. The front rotor fan and the rear rotor fan are stacked with each other of a total thickness. A ratio of the total thickness to the greater one between the front blade diameter and the rear blade diameter is less than or equal to about 0.75

In comparison with the related art, the ratio of the diameter of the front (rear) hub to the diameter of the front (rear) blade is about 0.3 to about 0.85. The front average pitch angle of the front blades is greater than about 46 degrees, and the rear average pitch angle of the rear blades is less than about 38 degrees. Furthermore, the amount of the front blades is greater than or equal to the amount of the rear blades. The front rotor fan and the rear rotor fan are stacked with each other to have a total thickness. The ratio of the total thickness to the greater one between the front blade diameter and the rear blade diameter is less than or equal to about 0.75. Moreover, the thin type counter-rotating axial air moving device in this disclosure has a characteristic of higher air pressure and air flowrate than that of the counter-rotating axial air moving device in the related art at the same rotation speed per the specific design parameters as disclosed. Therefore, the deterioration of vibration and noise caused by the increasing the rotation speed may be avoided. As a result, it has advantages of less installation space and thickness etc., in this disclosure.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
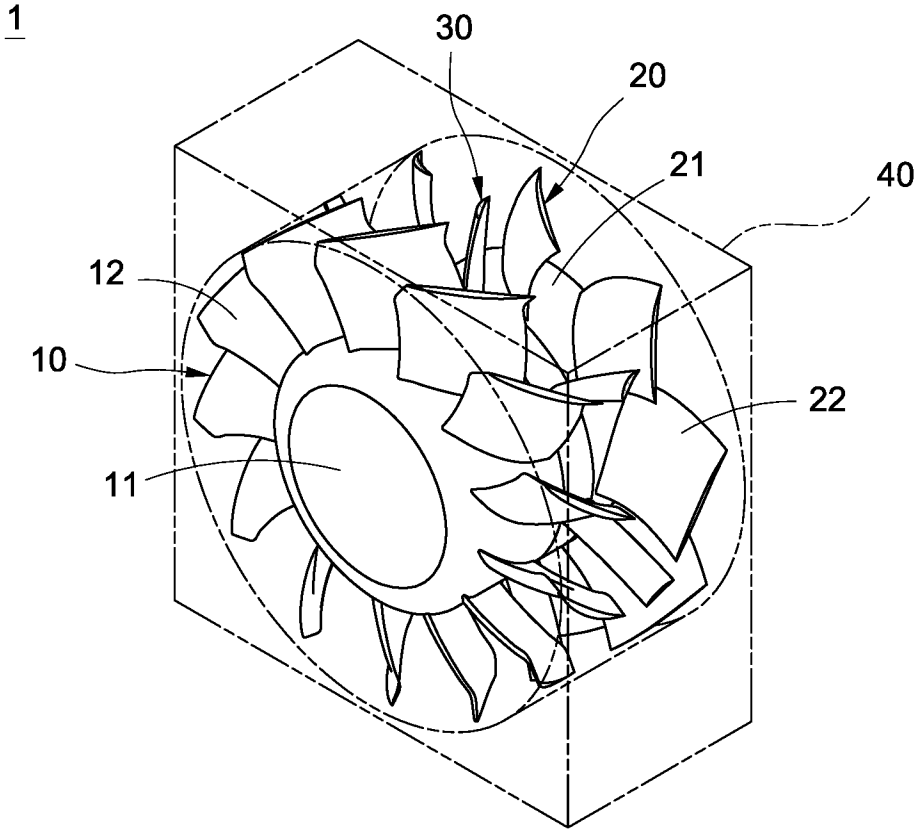
FIG. 1 is a perspective schematic view of the thin type counter-rotating axial air moving device in this disclosure.
Figure 2:
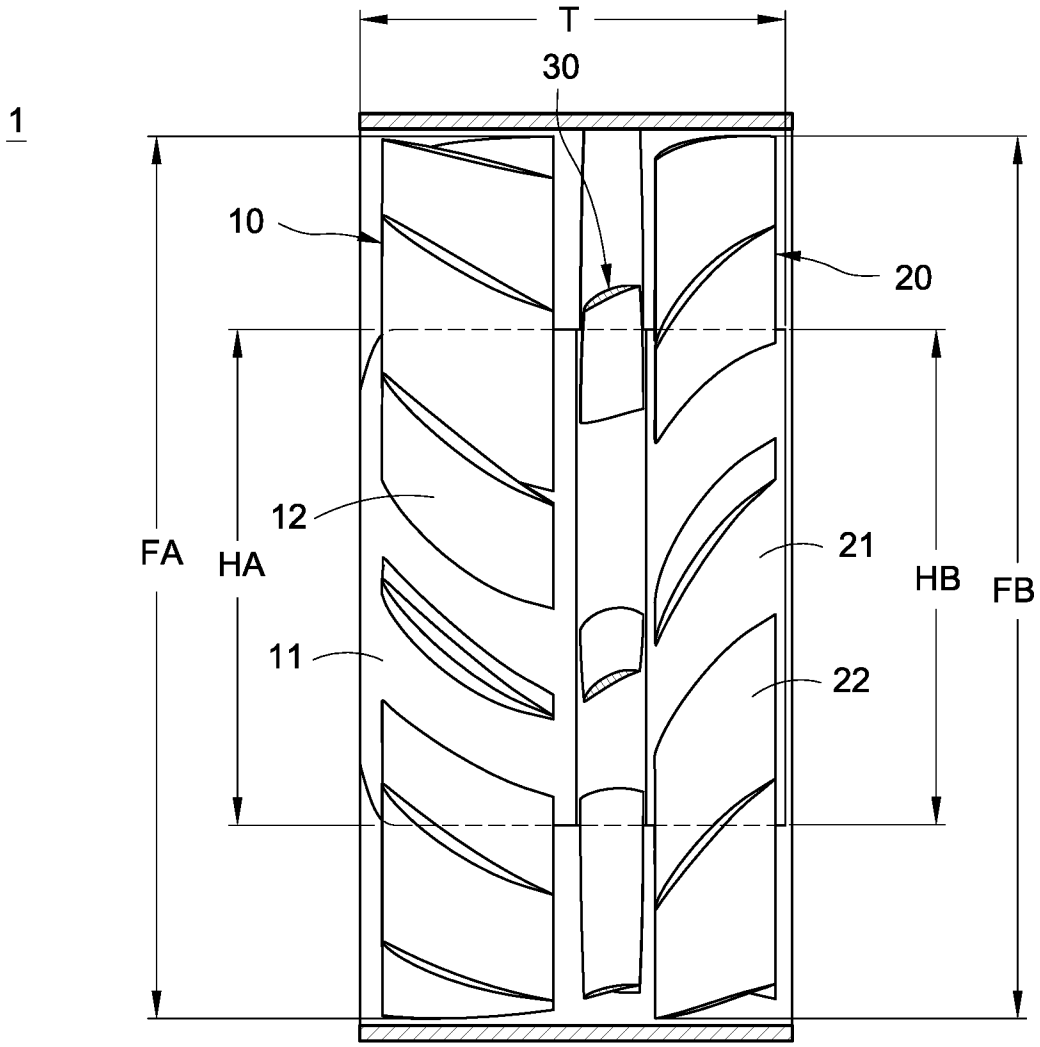
FIG. 2 is a cross sectional view of the thin type counter-rotating axial air moving device in this disclosure.

Please refer to FIG. 1 and FIG. 2, which respectively depict a perspective schematic view and a cross sectional view of the thin type counter-rotating axial air moving device in this disclosure. The thin type counter-rotating axial air moving device 1 of this disclosure includes a front rotor fan 10 and a rear rotor fan 20. The rear rotor fan 20 is disposed on a downstream side of the front rotor fan 10 to configure the thin type counter-rotating axial air moving device 1. Additionally, the rotation direction of the front rotor fan 10 and the rear rotor fan 20 are opposite, and the diameter of the front rotor fan 10 and the diameter of the rear rotor fan 20 are approximately the same.

The front rotor fan 10 includes a front hub 11 and a plurality of front blades 12 arranged annularly and spacedly on the periphery of the front hub 11. The front hub 11 includes a front hub diameter HA, and each of the front blades 12 includes a front blade diameter FA. The ratio of the front hub diameter HA to the front blade diameter FA is about 0.3 to about 0.85. Additionally, the front rotor fan 10 includes a front rotation speed SA.

Similarly, the rear rotor fan 20 includes a rear hub 21 and a plurality of rear blades 22 arranged annularly and spacedly on the periphery of the rear hub 21. The rear hub 21 includes a rear hub diameter HB, and each of the rear blades 22 includes a rear blade diameter FB. The ratio of the rear hub diameter HB to the rear blade diameter FB is about 0.3 to about 0.85. Additionally, the rear rotor fan 20 includes a rear rotation speed SB.

Moreover, the front rotor fan 10 and the rear rotor fan 20 are stacked with each other to have a total thickness T. The ratio of the total thickness T to the greater one between the front blade diameter FA and the rear blade diameter FB is less than or equal to about 0.75. Additionally, the ratio of the rear rotation speed SB to the front rotation speed SA is about 0.8 to about 1.3.

In this embodiment, the front blade diameter FA and the rear blade diameter FB are approximately the same. Accordingly, the ratio of the total thickness T to the front blade diameter FA (or the rear blade diameter FB) is about 0.49. Additionally, the ratio of the rear rotation speed SB to the front rotation speed SA is about 1.048. Furthermore, the ratio of the front hub diameter HA to the front blade diameter FA (or the rear hub diameter HB to the rear blade diameter FB) is about 0.56.

It is worth noticing that the amount of the front blades 12 is greater than or equal to the amount of the rear blades 22. Specifically, the amount of the front blades 12 is greater than or equal to five, and the amount of the rear blades 22 is greater than or equal to four.

In one embodiment of this disclosure, the thin type counter-rotating axial air moving device 1 further includes a stator component 30 and a housing 40. The stator component 30 is connected to the housing 40 and may be optionally located on the front side of the front rotor fan 10, on the rear side of the rear rotor fan 20, or between the front rotor fan 10 and the rear rotor fan 20. In some embodiments, the stator component 30 includes a plurality of pillars or a plurality of stator blades, and the pillars or the stator blades are arranged radially corresponding to the type of the rotor fans. In this embodiment, the stator component 30 includes a plurality of static blades, and the function of the stator blades is to recover the rotational kinetic energy of the airflow.

Figure 3:
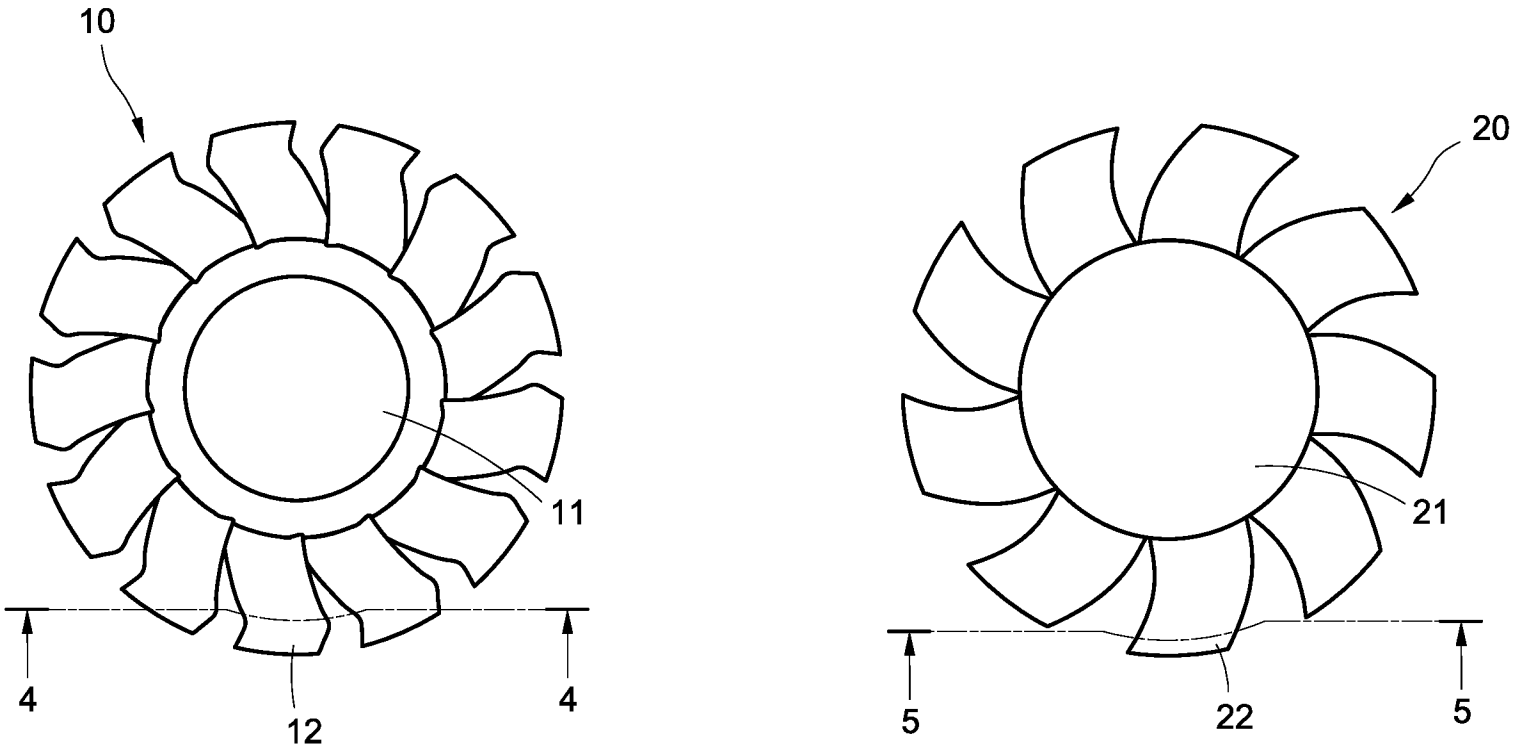
FIG. 3 is a top view of the front rotor fan and the rear rotor fan in this disclosure.

Please further refer to FIG. 3 to FIG, 5, they respectively depict a top view of the front rotor fan and the rear rotor fan in this disclosure, a schematic view of the pitch angle of the front blades and a schematic view of the pitch angle of the rear blades. In FIG. 3, the front blade 12 includes a wing section BA formed by a cross sectional view made along the line 3-3 of the blade. Additionally, the rear blade 22 includes another wing section BB formed by a cross sectional view made along the line 5-5 of the blade.

Figure 5:
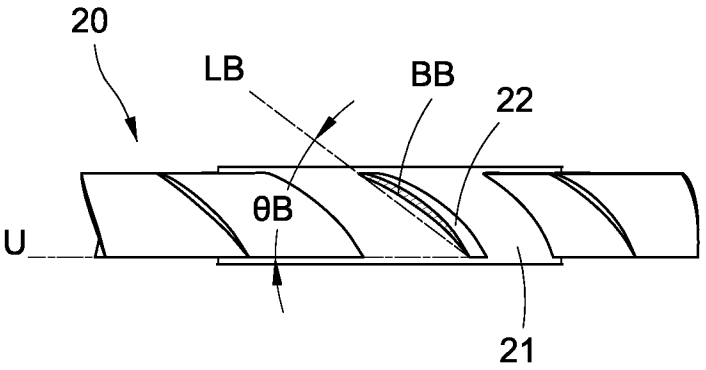
FIG. 5 is a cross sectional view along line 5-5 in FIG. 3.
Figure 4:
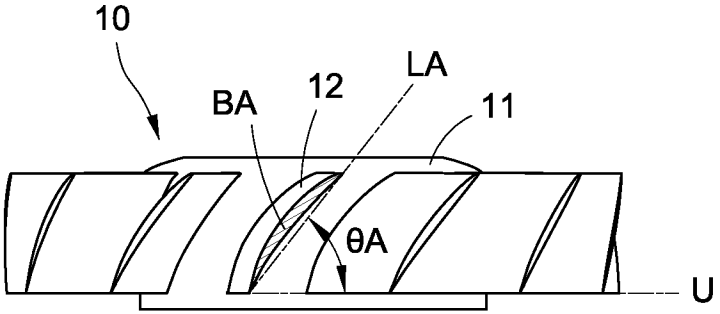
FIG. 4 is a cross sectional view along line 4-4 in FIG. 3.

Please refer to FIG. 4 and FIG. 5. In FIG. 4, the angle formed by the nose-tail line LA of the wing section BA and the rotation direction U of the front rotor fan 10 is defined as the pitch angle $\theta_A$. Furthermore, In the FIG. 5, the angle formed by the nose-tail line LB of the wing section BB and the rotation direction U of the rear rotor fan 20 is defined as the pitch angle $\theta_B$.

It should be noted that the pitch angles of the wing sections on different radius positions may be different. The $\theta_A$ refers to the front average pitch angle of the front blades hereafter, and the $\theta_B$ refers to the rear average pitch angle of the rear blades. The front average pitch angle $\theta_A$ of the front blades 12 of the thin type counter-rotating axial air moving device 1 in this disclosure is greater than about 46 degrees. Additionally, the rear average pitch angle $\theta_B$ of the rear blades 22 is less than about 38 degrees.

Moreover, the amount of the front blades 12 is thirteen, and the amount of the rear blades 22 is nine. The front average pitch angle $\theta_A$ of the front blades 12 is about 50.76 degrees, and the rear average pitch angle $\theta_B$ of the rear blades 22 is about 35.56 degrees. It should be noted that the front blades 12 and the rear blades 22 of this embodiment respectively have changes in the sweep angles.

Figure 6:
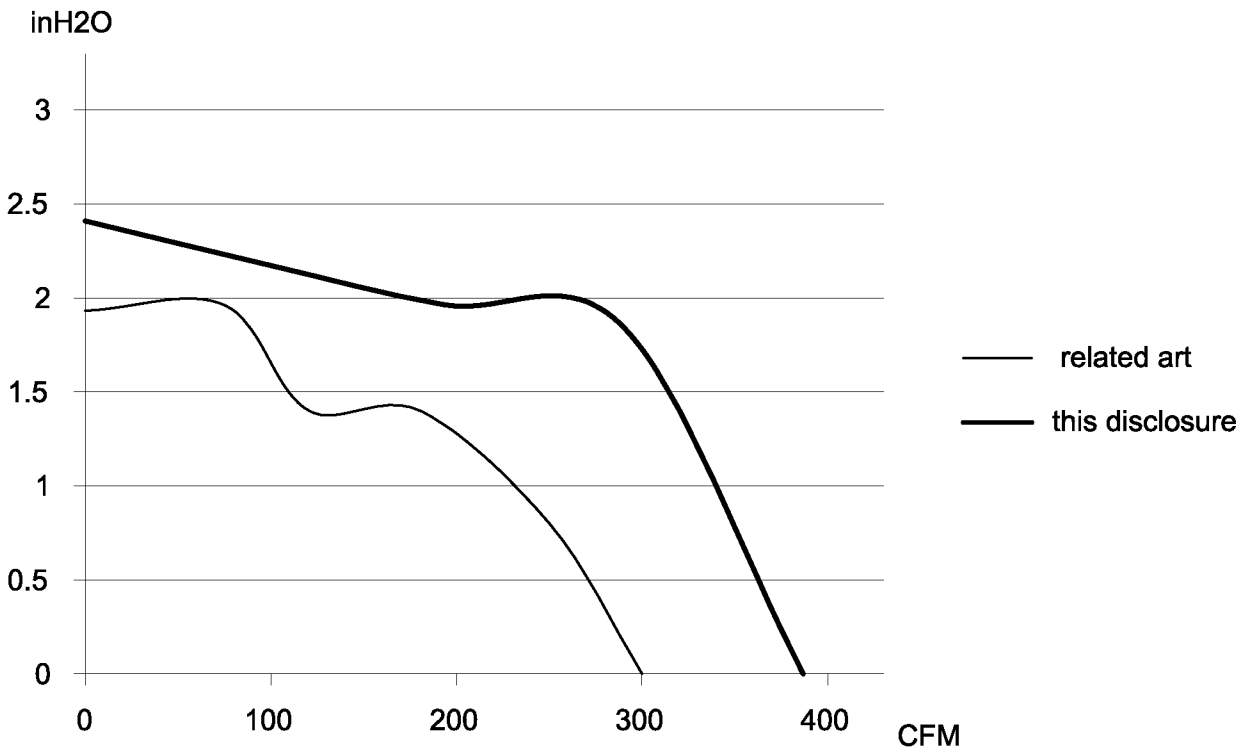
FIG. 6 is a comparison diagram of the curves of the static pressure versus air flowrate of the thin type counter-rotating axial air moving device in this disclosure and the counter-rotating axial air moving device in the related art.

Please refer to FIG. 6, it depicts a comparison diagram of the curves of the static pressure versus air flowrate of the thin type counter-rotating axial air moving device in this disclosure and the counter-rotating axial air moving device in the related art. It is shown in the figure, under the same air pressure, the curve of the thin type counter-rotating axial air moving device in this disclosure (represented in the thin line) is in a higher air flowrate region comparing with the curve of the counter-rotating axial air moving device in the related art (represented in the thick line). In other words, in the environment of the same resistance, the thin type counter-rotating axial air moving device of this disclosure has a higher air flowrate. Additionally, the thickness of the device in this disclosure is less than that of the related art. Accordingly, the thin type counter-rotating axial air moving device of this discourse may provide better characteristics and performance than that of the counter-rotating axial air moving device of the related art under the same diameter and rotation speed. Therefore, the deterioration due to vibration and noise caused by the increasing the rotation speed may be avoided. As a result, it has advantages of less installation space and thickness etc.

Figure 7:
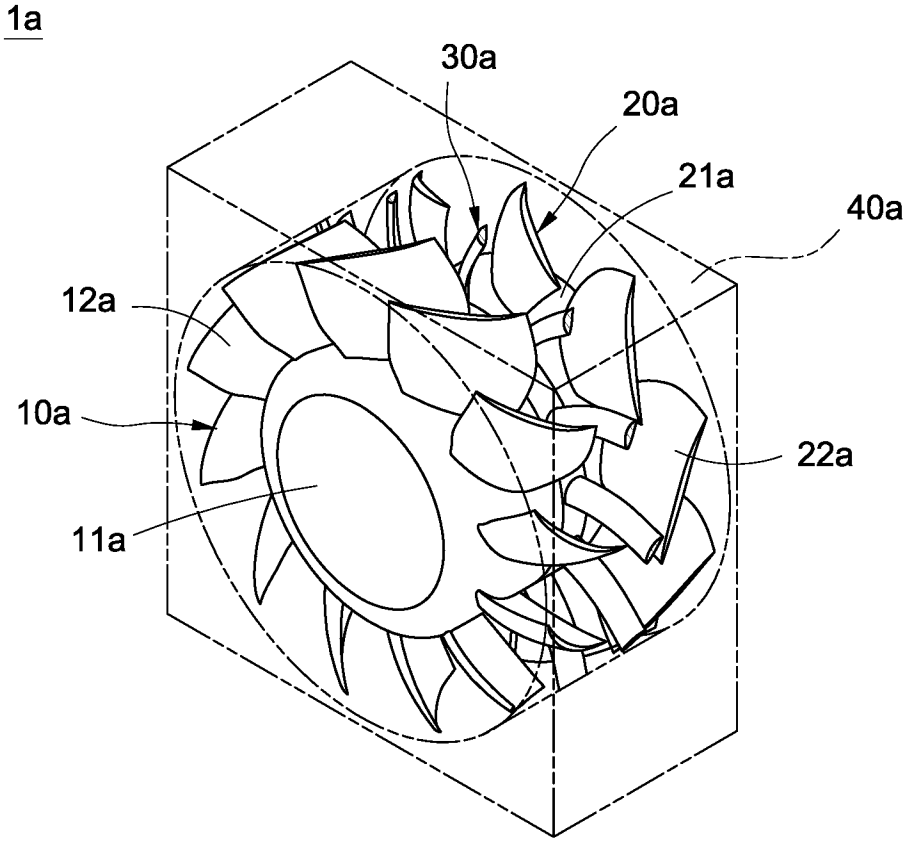
FIG. 7 is a perspective schematic view of another embodiment of the thin type counter-rotating axial air moving device in this disclosure.
Figure 8:
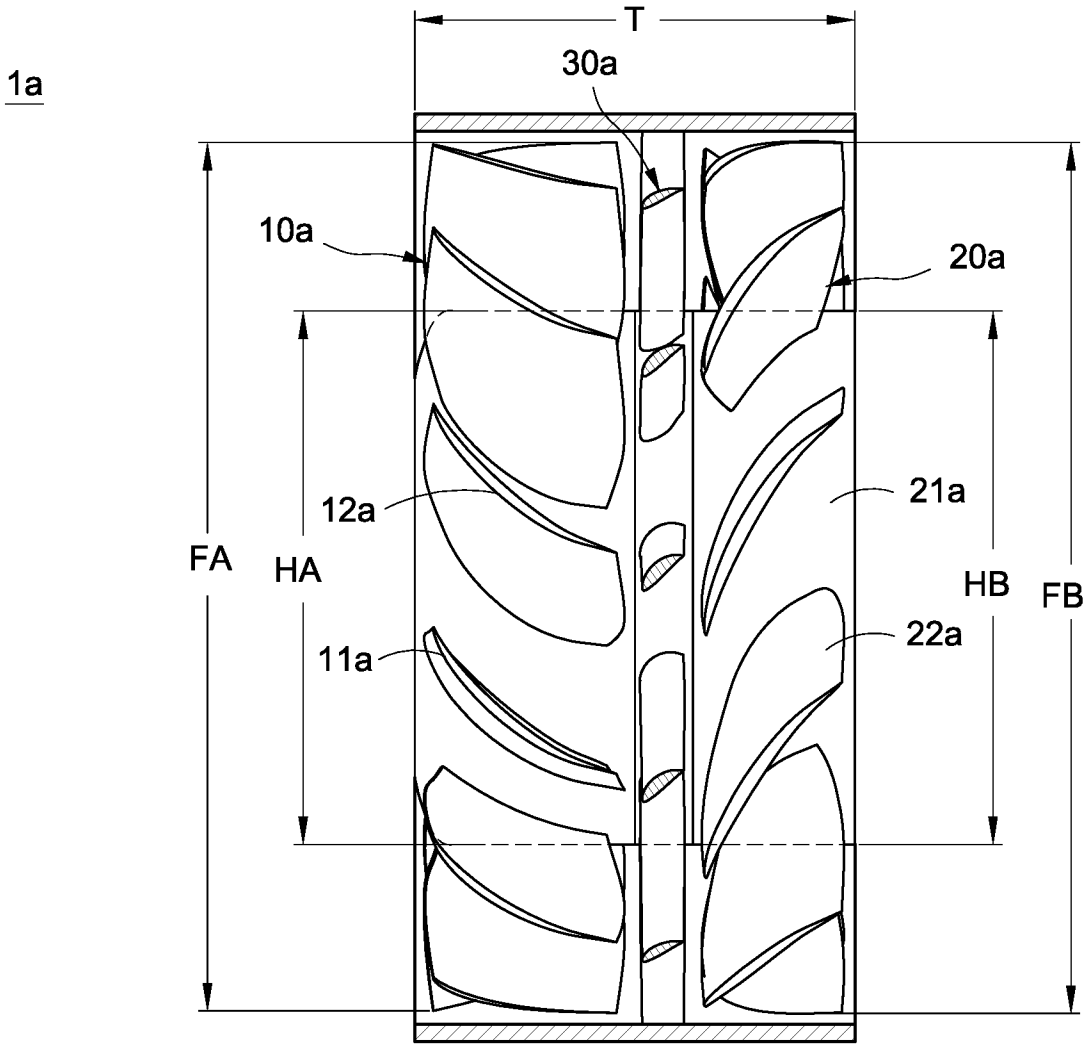
FIG. 8 is a cross sectional view of another embodiment of the thin type counter-rotating axial air moving device in this disclosure.

Please refer to FIG. 7 and FIG. 8, which depict another embodiment of the thin type counter-rotating axial air moving device in this disclosure. In this embodiment, the thin type counter-rotating axial air moving device 1*a* includes a front rotor fan 10*a*, a rear rotor fan 20*a*, a stator component 30*a*, and a housing 40*a*. The front rotor fan 10*a* includes a front hub 11*a* and a plurality of front blades 12*a*, and the amount of the front blades 12*a* is twelve. Additionally, the rear rotor fan 20*a* includes a rear hub 21*a* and a plurality of rear blades 22*a*, and the amount of the rear blades 22*a* is ten.

In this embodiment, the front blade diameter FA and the rear blade diameter FB are approximately the same. The ratio of the total thickness T to the front blade diameter FA (or the rear blade diameter FB) is about 0.505. Additionally, the ratio of the rear rotation speed SB to the front rotation speed SA is about 1.059. Furthermore, the ratio of the front hub diameter HA to the front blade diameter FA (or the rear hub diameter HB to the rear blade diameter FB) is about 0.61.

Moreover, in this embodiment, the front average pitch angle $\theta_A$ of the front blades 12*a* is about 60 degrees, and the rear average pitch angle $\theta_B$ of the rear blades 22*a* is about 31 degrees. It should be noted that the front blades 12*a* of this embodiment have changes in the sweep angles.

Figure 9:
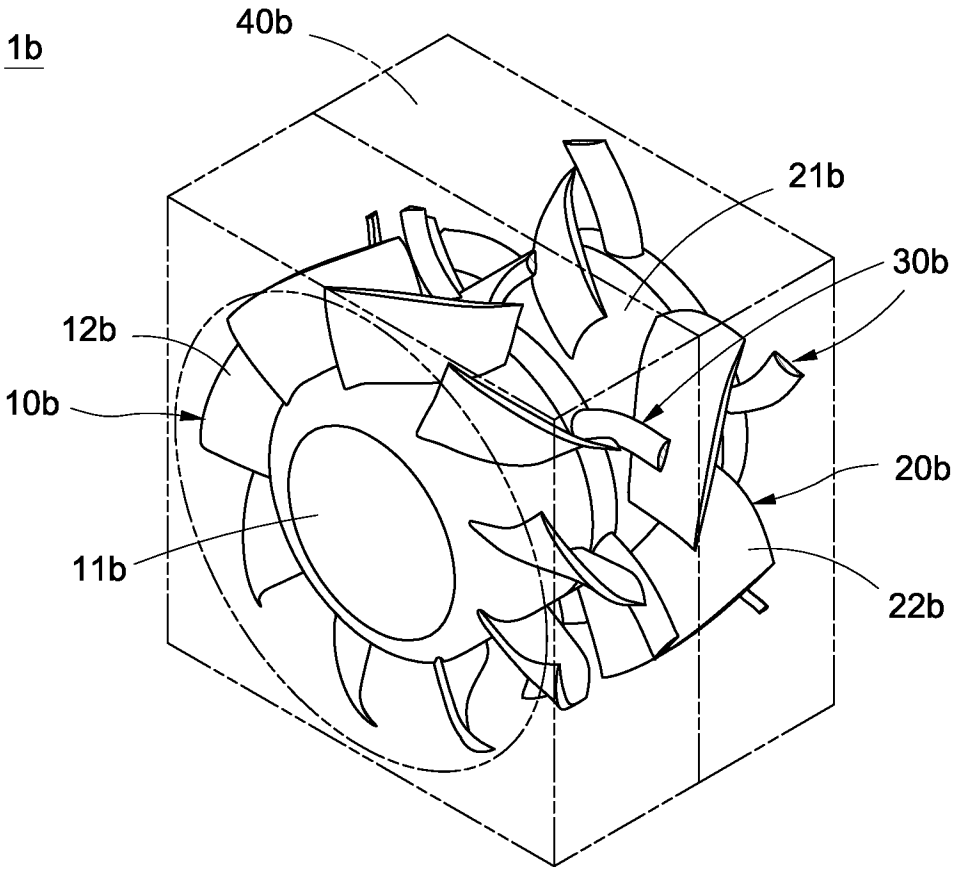
FIG. 9 is a perspective schematic view of still another embodiment of the thin type counter-rotating axial air moving device in this disclosure.
Figure 10:
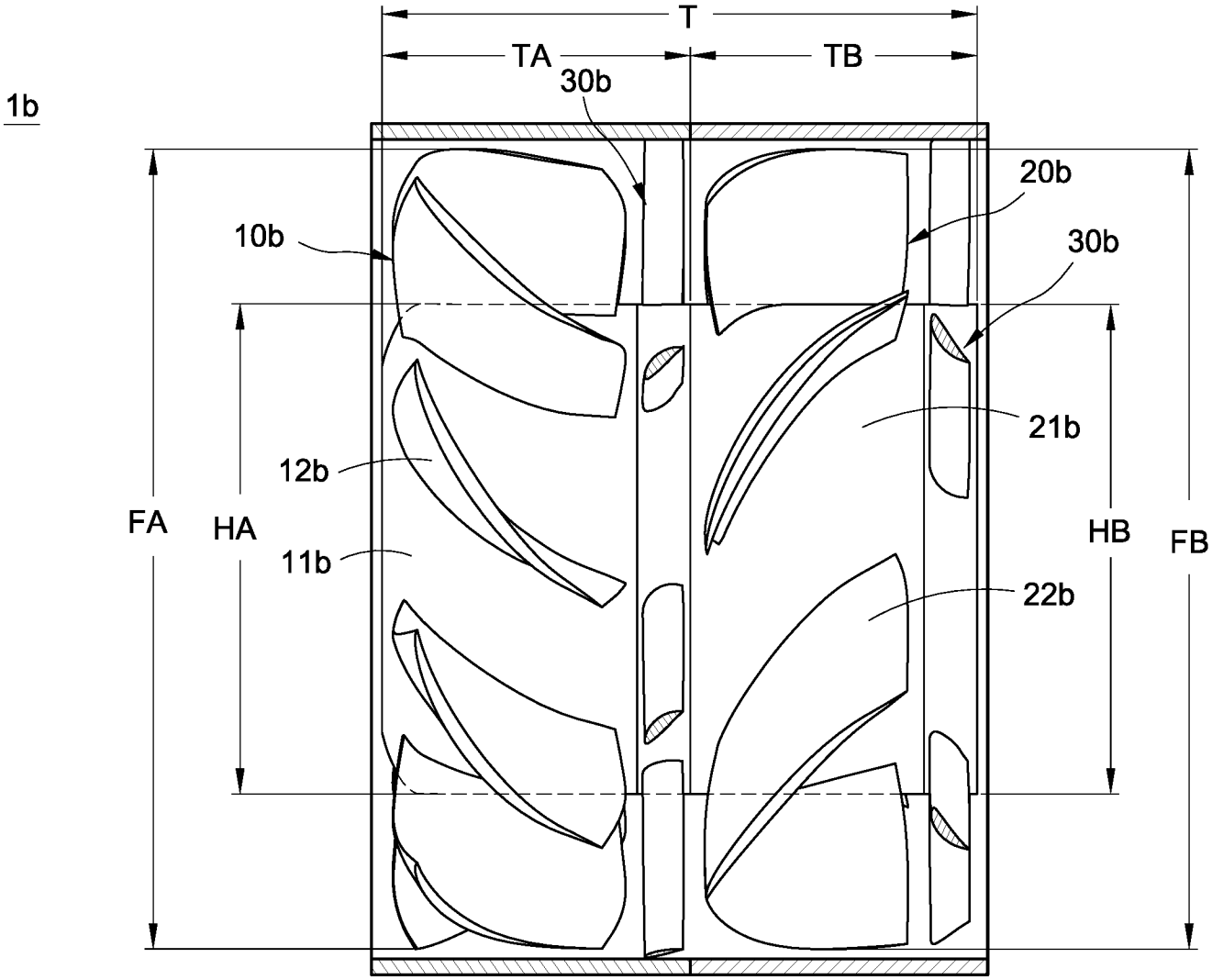
FIG. 10 is a cross sectional view of still another embodiment of the thin type counter-rotating axial air moving device in this disclosure.

Please further refer to FIG. 9 and FIG. 10, which depict still another embodiment of the thin type counter-rotating axial air moving device in this disclosure. In this embodiment, the thin type counter-rotating axial air moving device 1*b* includes a front rotor fan 10*b*, a rear rotor fan 20*b*, a plurality of stator components 30*b* and a housing 40*b*. The front rotor fan 10*b* includes a front hub 11*b* and a plurality of front blades 12*b*. The amount of the front blades 12*b* is nine. Additionally, the rear rotor fan 20*b* includes a rear hub 21*b* and a plurality of rear blades 22*b*. The amount of the rear blades 22*b* is six.

In this embodiment, the front blade diameter FA and the rear blade diameter FB are approximately the same. The ratio of the total thickness T to the front blade diameter FA (and/or to the rear blade diameter FB) is about 0.744. Additionally, the ratio of the rear rotation speed SB to the front rotation speed SA is about 0.98. Furthermore, the ratio of the front hub diameter HA to the front blade diameter FA (or the rear hub diameter HB to the rear blade diameter FB) is about 0.612.

Furthermore, in this embodiment, the front average pitch angle $\theta_A$ of the front blades 12*b* is about 49.3 degrees. The rear average pitch angle $\theta_B$ of the rear blades 22*b* is about 37.1 degrees. It should be noted that, neither the front blades 12*b* nor the rear blades 22*b* in this embodiment have changes in the sweep angles. It is also worth noting that, in this embodiment, the thin type counter-rotating axial air moving device 1*b* includes two stator components 30*b*. The two stator components 30*b* are respectively arranged on the rear side of the front rotor fan 10*b* and the rear rotor fan 20*b*. As a result, the front rotor fan 10*b* and the rear rotor fan 20*b* are arranged at intervals without connecting.

While this disclosure has been described by means of specific embodiments, numerous modifications and variations could be made thereto by those skilled in the art without departing from the scope and spirit of this disclosure set forth in the claims.

What is claimed is:

1. A counter-rotating axial air moving device, comprising:

a front rotor fan, comprising a front hub and a plurality of front blades arranged annularly and spacedly on a periphery of the front hub, wherein the front hub comprises a front hub diameter, and each of the front blades comprises a front average pitch angle; the plurality of front blades defining a front blade diameter, and a ratio of the front hub diameter to the front blade diameter is 0.3 to 0.85, and the front average pitch angle is greater than 46 degrees;

rear rotor fan, disposed on a downstream side of the front rotor fan, and comprising a rear hub and a plurality of rear blades arranged annularly and spacedly on a periphery of the rear hub, wherein the rear hub comprises a rear hub diameter, and each of the rear blades comprises a rear average pitch angle; the plurality of rear blades defining a rear blade diameter, and a ratio of the rear hub diameter to the rear blade diameter is 0.3 to 0.85, and the rear average pitch angle is less than 38 degrees; and a stator component, located between the front rotor fan and the rear rotor fan;

wherein, an amount of the front blades is greater than or equal to an amount of the rear blades, the front rotor fan and the rear rotor fan are stacked with each other of a total thickness, wherein the total thickness is defined as a thickness of the front hub, a thickness of the stator component and a thickness of the rear hub; and a ratio of the total thickness to the greater one between the front blade diameter and the rear blade diameter is less than or equal to 0.75.

2. The counter-rotating axial air moving device in claim 1, wherein the amount of the front blades is greater than or equal to five, and the amount of the rear blades is greater than or equal to four.

3. The counter-rotating axial air moving device in claim 1, wherein the front rotor fan comprises a front rotation speed, and the rear rotor fan comprises a rear rotation speed, and a ratio of the rear rotation speed to the front rotation speed is 0.8 to 1.3.

4. The counter-rotating axial air moving device in claim 1, wherein the stator component comprises a plurality of pillars or a plurality of stator blades, and the pillars or the stator blades are arranged radially.

5. The counter-rotating axial air moving device in claim 1, wherein a rear rotation speed of the rear rotor fan is greater than a front rotation speed of the front rotor fan.

* * * * *